US006289712B1

(12) United States Patent
Beetz et al.

(10) Patent No.: US 6,289,712 B1
(45) Date of Patent: Sep. 18, 2001

(54) PLIERS FOR CRIMPING WORK PIECES

(75) Inventors: Horst Beetz, Stadtallendorf; Kurt Battenfeld, Ebsdorfergrund-Wittelsberg, both of (DE)

(73) Assignee: WEZAG GmbH Werkzeugfabrik, Stadtallendorf (DE)

( * ) Notice: Subject to any disclaimer, the term of this patent is extended or adjusted under 35 U.S.C. 154(b) by 0 days.

(21) Appl. No.: 09/577,631

(22) Filed: May 24, 2000

(30) Foreign Application Priority Data

May 26, 1999 (DE) ..... 199 24 087

(51) Int. Cl.[7] ..... B21D 7/06

(52) U.S. Cl. ..... 72/409.16; 72/409.01; 72/416; 72/409.12

(58) Field of Search ..... 72/409.01, 409.12, 72/409.16, 416; 29/751; 81/313

(56) References Cited

U.S. PATENT DOCUMENTS

| | | | | |
|---|---|---|---|---|
| 1,142,797 | * | 6/1915 | Burrell | 72/409.16 |
| 1,568,934 | * | 1/1926 | Tull | 81/378 |
| 2,519,973 | * | 8/1950 | Mead | 81/378 |
| 2,672,778 | * | 3/1954 | Jones | 81/377 |
| 2,814,222 | * | 11/1957 | Sanders | 81/378 |
| 2,838,970 | | 6/1958 | Motches et al. | 81/15 |
| 2,842,996 | * | 7/1958 | Coslow | 81/378 |
| 5,138,864 | * | 8/1992 | Tarpill | 72/409.12 |
| 5,280,716 | * | 1/1994 | Ryan | 72/409.07 |
| 6,161,416 | * | 12/2000 | Wilhelm | 72/409.08 |

FOREIGN PATENT DOCUMENTS

| | | | | |
|---|---|---|---|---|
| 21 49 167 | | 10/1971 | (DE) . | |
| 2519175 | * | 11/1976 | (DE) | 81/378 |
| 34 11 397 C2 | | 8/1984 | (DE) . | |
| 197 09 639 A1 | | 3/1997 | (DE) . | |
| 297 17 314 U1 | | 9/1997 | (DE) . | |
| 0 771 615 A1 | | 5/1997 | (EP) . | |

* cited by examiner

*Primary Examiner*—Daniel C. Crane
(74) *Attorney, Agent, or Firm*—Thomas, Kayden, Horstemeyer & Risley

(57) ABSTRACT

Pliers for crimping work pieces include a first stationary handle (1) and a second movable handle (2). The first and second handle (1, 2) are designed and arranged to be movable with respect to one another and to be operable by one hand. A first pivot jaw (3) is connected to the first stationary handle (1) to form a stationary pliers portion. A second pivot (4) jaw is connected to the second movable handle (2). The first and second pivot jaw (3,4) each includes at least two parallel plates (43, 33; 45, 46) extending symmetrically to a plane of main extension (19) of the pliers. A common joint (5) pivotally connects the stationary pliers portion to the second pivot jaw (4). A first die (32) is designed as a semi shell (34) and to be insertable into the first pivot jaw (3). A second die (33) is designed as a semi shell (35) and to be insertable into the second pivot jaw (4). The first and second die (32, 33) together form a crimping die (8), and they are designed and arranged to contact one another in a closed position of the pliers in a separation plane (37). At least one of the semi shells (34, 35) is arranged at the corresponding pivot jaw (3, 4) with a clearance (38) to be movable in the separation plane (37) in the sense of a centering adjustment of the semi shells (34, 35).

19 Claims, 3 Drawing Sheets

-19-

8
37
41
32
34
38
39
33
41
40
4,45,46
35
61
10
11
12
21
13
31
26
15
14
30
2
29
23
24
25
27
59
3,43,46
42
6
5
7
58
36
16
28
20
17
18
31
22
1

PLIERS FOR CRIMPING WORK PIECES

CROSS REFERENCE TO RELATED APPLICATIONS

This application claims the benefit of co-pending German Patent Application No. 199 24 087.6-15 entitled "Zange zum Verpressen von Fassungen, Rohren, Kabelschuhen und dgl." filed on May 26, 1999.

FIELD OF THE INVENTION

The present invention generally relates to pliers for crimping work pieces. More particularly, the present invention relates to pliers including plates and being operable with one hand.

BACKGROUND OF THE INVENTION

Such pliers are also called crimping pliers or pressing pliers. Depending on the design of the work piece, especially in case of fittings, tubes and the like to be crimped, substantial pressing forces have to be applied onto the work piece. On the other hand, such work pieces may have comparatively great dimensions. Consequently, the crimping die being formed by two dies should have a great opening in the opened position of the pliers to be able to move the two dies over the work piece to be crimped in the opened position of the pliers. At the beginning of the closing movement of the pliers, there are no or no substantial pressing forces to be overcome. Contrarily, the pressing forces to be applied during the actual crimping movement of the work piece are substantial.

Pliers for crimping work pieces are known from German patent application DE 197 09 639 A1. The pliers include two handles being movable with respect to one another by one hand. To pivot jaws are supported by a joint. One of the pivot jaws is connected to a stationary handle to form a stationary portion of the pliers. The other pivot jaw is pivotally connected to the stationary portion of the pliers by the joint. The pliers include separated dies forming a crimping die. A locking mechanism serves to reach a defined end position of the separated dies. A pressure lever is arranged between the handles, and it is pivotable by the supporting joint. The pressure lever together with a section of the movable handle forms a toggle lever drive. The two dies and the corresponding pivot jaws are designed as one piece. They are produced by precision casting. The fixed connection of the combined pivot jaw/die to the stationary handle is disadvantageous. The preciseness of the finished crimped work piece highly depends on the realizable process tolerances with which the elements of the pliers are produced and which are used to assemble the pliers. Consequently, in many cases it is necessary to rework the pliers. The known pliers include handles made of molded plastic. These handles bring a great stability at a reduced exactness. Since the material flows, disadvantageous displacements of prearrange bores cannot be prevented.

Pliers for producing solderless connections between current conduits and corresponding connection elements by crimping the work pieces are known from German Auslegeschrift DE-AS 21 49 167. The pliers have a plate design, and they provide the corresponding advantages. The rather simple and exact production of the plates, for example by punching, is advantageous.

Linearly driven pliers having a plate design are known from German patent 34 11 397 C2. The necessary forces for producing solderless connections are not substantial.

SUMMARY OF THE INVENTION

Briefly described, the present invention provides pliers for crimping work pieces. The pliers include a first stationary handle and a second movable handle. The first and second handle are designed and arranged to be movable with respect to one another and to be operable by one hand. A first pivot jaw is connected to the first stationary handle to form a stationary pliers portion. A second pivot jaw is connected to the second movable handle. The first and second pivot jaw each includes at least two parallel plates extending symmetrically to a plane of main extension of the pliers. A common joint pivotally connects the stationary pliers portion and the second pivot jaw. A first die is designed as a semi shell and to be insertable into the first pivot jaw. A second die is designed as a semi shell and to be insertable into the second pivot jaw. The first and second die together form a crimping die, and they are designed and arranged to contact one another in a closed position of the pliers in a separation plane. At least one of the semi shells is arranged at the corresponding pivot jaw with a clearance to be movable in the separation plane in the sense of a centering adjustment of the semi shells.

The present invention is based on the concept of designing the pliers user friendly and for applying great crimping forces. It is desired to ensure that the pliers may be used and operated by one hand. This means that the handles need to be designed in a way that they may be grasped by the fingers of one hand of the user even in the opened position of the pliers. On the other hand, producing tolerances should be kept as small as possible. A plate design of the pliers is especially suitable for attaining small producing tolerances. The plate design also makes it possible to better introduce and distribute the pressing forces in the dies and in the semi shells, respectively. The use of semi shells allows for a great exactness and easy manufacture, for example by turning on a lathe. Additionally, the roundness of the crimped work piece is improved. The clearance allowing for a centering movement in the direction of the separation area of the dies has a positive effect. There is an automatic centering movement when the work piece is crimped. The clearance also makes it possible to easily remove and replace the semi shells. With the novel pliers, it is possible to apply great crimping forces, as they are necessary for plastically deforming the work piece. This is achieved by a one-hand operation and even in case of undesired working conditions. The short structural length and the low weight of the pliers allow for a one-hand operation. The pliers include a locking mechanism locking in at an early time such that the pliers cannot leave a half opened position by themselves. During the actual crimping action, it is possible to put both hands around the already approached handles to produce a crimping force being sufficient to plastically deform metals. The pliers are also handy in case of tight working conditions, and they may be opened in the region of the dies fairly wide without losing the possibility of operating the pliers by one hand.

The locking mechanism is arranged between the stationary handle and the pivot jaw being pivotable by a joint. The locking mechanism is of great importance to the pliers. The jack of the locking mechanism is resiliently movable but stationary, and it may be arranged at the stationary handle. The locking mechanism should include a tooth segment including a majority of teeth. The tooth segment is arranged on the movable pivot jaw, or it is at least connected thereto. The pliers may be adjusted in a way that the closing position is reliably attained, and that a great crimping pressure is reproducibly applied before the pliers may be reopened, or before they are reopened by a spring.

In a preferred embodiment of the pliers, both pivot jaws include three plates, the center plate of which is arranged in the plane of main extension of the pliers. The center plate together with the two other plates being arranged symmetrically with respect to the plane of main extension of pliers allows for an introduction of force into the dies being designed as semi shells. Additionally, crimping forces are introduced into the semi shells in a spaced apart manner to advantageously have an effect along at the length of the semi shells.

The center plate of each pivot jaw may be pivotable with respect to the other plates to replace the dies. Thus, the center plate fulfills a further function. The semi shells at their other circumference include a continuous channel being centeringly engaged by the center plates.

The plates of each pivot jaw may be interconnected by an additional securing pin. Such a securing pin or bolt is not absolutely necessary for a pivotal movement. Nevertheless, it has a positive effect on the plates remaining parallel, and it prevents the plates from being twisted and tilt.

The additional securing pin is preferably designed to be removable. It may be used to remove and to replace the semi shells. Replacing the semi shells is to be understood as removing worn out dies or otherwise spoiled dies, and as replacing them by dies of the same geometry or by dies of a different geometry.

A manually operable pivot lever may be arranged at the pivot jaw for replacing the die. This arrangement allows for a quick replacement of the dies. The pivot lever may be arranged in the plane of main extension or spaced apart thereto.

The pivot jaws, cheeks or noses may include protrusions serving to support the semi shells for radially fixing the dies. The pivot jaws may be easily and exactly produced by punching, especially with great transitional radiuses. The risk of fracture in case of load is reduced. The semi shells are securely supported at the pivot jaws. The protrusions are preferably arranged at an angle of more than 90 degrees, especially approximately 120 degrees, to extend away from the pivot jaws.

The handles of the pliers may include slip-on plastic covers or bodies including outwardly extending protrusions. The protrusions realize sliding protection in an undesired grip region. They improve the desired grip of the handles at the right place.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
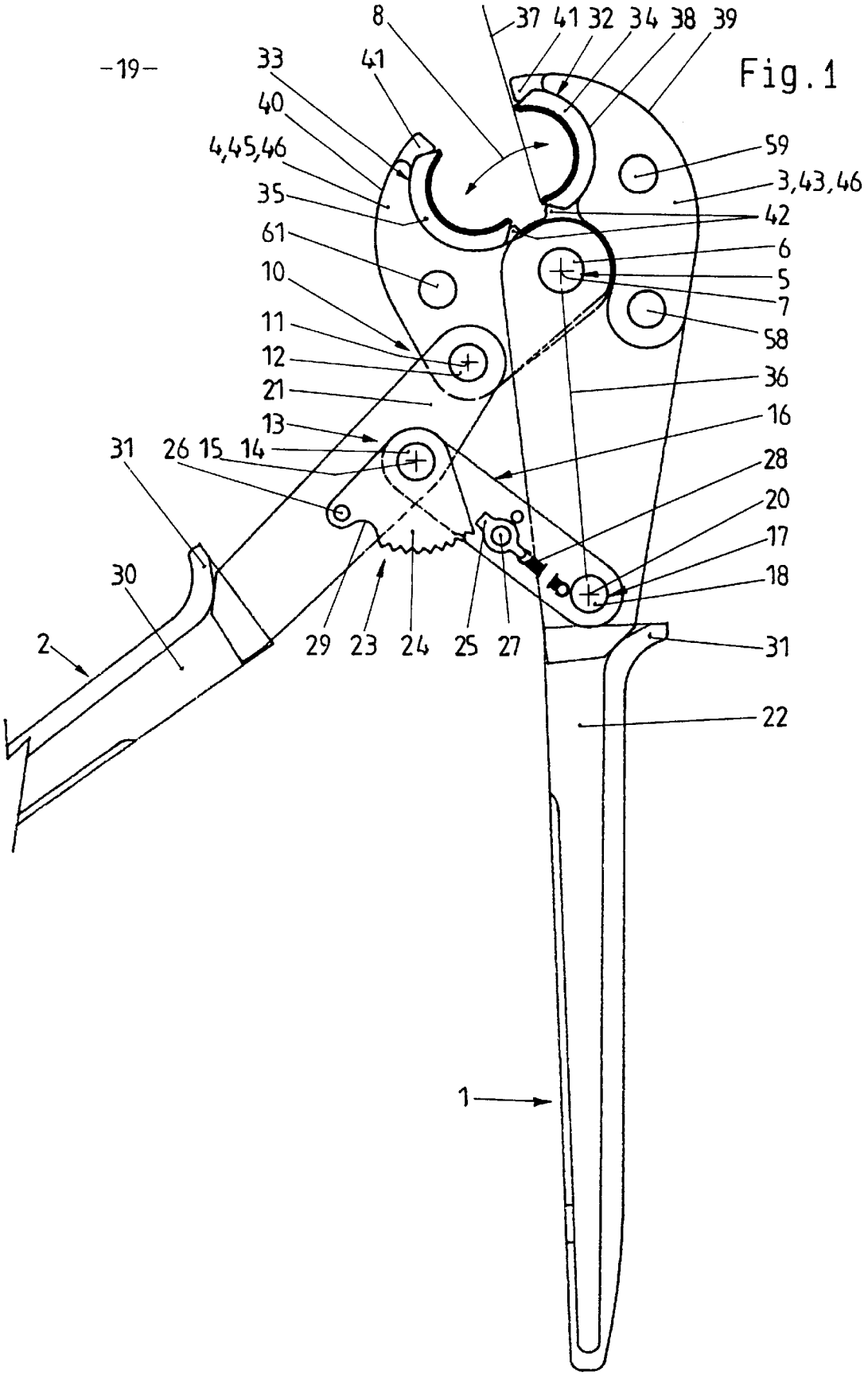
FIG. 1 is a side view of a first embodiment of the pliers in their opened position.
Figure 4:
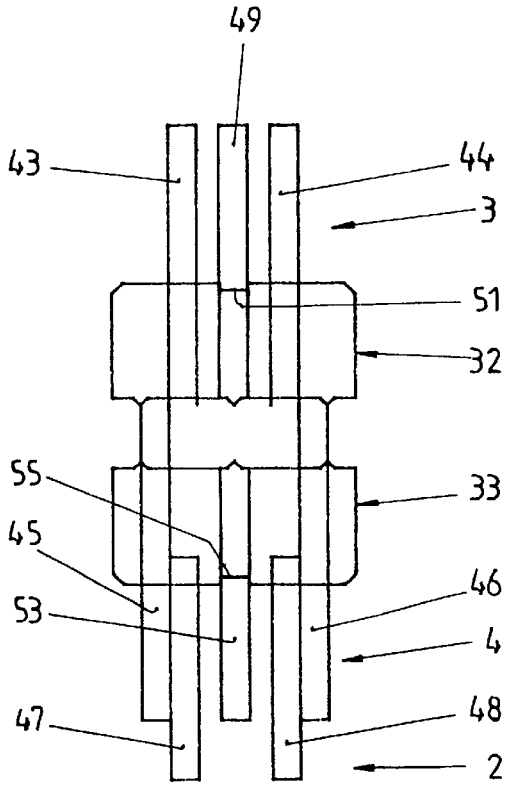
FIG. 4 is a front view of the pliers according to FIG. 2.

Referring now in greater detail to the drawings, FIG. 1 illustrates pliers including handles 1 and 2. The handle 1 is fixedly connected to a pivot jaw 3 to be commonly rotated and such that these two elements form a stationary portion of the pliers. The handle 1 is also referred to as stationary handle although, for an activation of the pliers, it is only important that there is a relative movement of the handles 1 and 2 with respect to one another. In addition to the stationary pivot jaw 3, there is a movable pivot jaw 4 being pivotally connected to the stationary portion of the pliers 1, 3 by a joint 5. The stationary handle 1 includes a plurality of plates, and it is designed as a semi shell. Its legs or plates 47, 48 (FIG. 4) extend symmetrically to the plane of main extension 19 of the pliers. A pin 6 extend through the legs or plates 47, 48, the movable pivot jaw 4 being designed and arranged to be pivotal about the axis 7 of the pin 6 with respect to the stationary pivot jaw 3. A crimping die 8 is located at the pivot jaws 3 and 4. The crimping die 8 includes two removable dies 32, 33 being designed in the form of semi shells 34, 35. The semi shells 34, 35 are connected to and supported in the pivot jaws 3 and 4, respectively. The crimping die 8 as exemplarily illustrates in FIG. 1 includes two semi shells 34, 35 being rotationally symmetrical both at their inner surfaces and at their outer surfaces. The crimping die 8 is designed as a body being separated in a plane of separation 37. The axial length of the semi shells 34, 35 in a direction perpendicular to the plane of illustration of FIG. 1 and to the plane of main extension 19, respectively, is more than, for example, the length of a union stem onto which a tube is to be connectingly and sealingly crimped. Preferably, the axis 9 (FIG. 2) of the crimping die 8 is located close to the joint 5 such that the distance between the axes 7 and 9 is small.

The movable pivot jaw 4 being associated with the movable handle 2 is enlarged in a lateral direction with respect to the stationary handle 1 to arrange a first support joint 10, the axis 11 of which being formed by a pin 12.

A second support joint 13 is arranged at the movable handle 2, the support joint 13 being formed by a pin 14 having an axis 15. A pressure lever 16 being arranged between the handles 1 and 2 is pivotally supported by the pin 14. The other end of the pressure lever 16 is pivotally supported in a third support joint 17. The support joint 17 is formed by a pin 18 supporting the pressure lever 16. The pin 18 may also be designed as an eccentric pin (not illustrated) to change the effective length of the pressure lever 16 and the closing position of the dies 32, 33 by rotating the eccentric pin. The adjustability of the closing position allows for compensating process tolerances and for precisely associating a closing position of the handles 1 and 2 with an end position of the crimping action. The adjustment of the pin 18 being designed as eccentric pin may also be used for readjustment, for example, to eliminate wear and tear in the chain of joints or in the crimping die 8.

The effective length of the pressure lever 16 is determined by the distance between the axis 15 of the support joint 13 and the axis 20 of the pin 18. The support joints 10 and 13 being arranged at the movable handle 2 define a portion 21 the effective length of which corresponds to the distance between the axes 11 and 15. The first ratio of transmission of the effective length of the pressure lever 16 with respect to the distance between the axes 11 and 15, meaning the effective length of the portion 21, is approximately between 1.6:1 and 1:1. Preferably, it is approximately 1.4:1. Consequently, the ratio of transmission is positive in the sense of providing for great crimping forces. The third support joint 17 of the pressure lever 16 is not arranged at the end of the stationary handle 1 facing the user of the pliers, but instead it is located closer to the head portion of the pliers including the crimping die 8. The handle 1 includes a plastic cover 22 being slid onto the handle 1, or being differently connected to the handle 1. The plastic cover 22 serves to easily grasp, hold and operate the handle 1 with one hand. The movable handle 2 also includes a plastic cover 30. Both plastic covers 22, 30 include outwardly protruding protrusions 31 preventing the hand of the user from sliding off the pliers. These portions of the pliers in their opened position are located at a distance of maximally about 110 mm such that the handles 1 and 2 may be held by the user with one hand.

The second ratio of transmission is determined by the distance between the axis 7 and 11 and the distance between the axis 9 and 7. The second ratio of transmission is chosen to be as great as possible, and it is in the range of approximately 1.6:1 and 2.0:1. Preferably, it is approximately 1.8:1. The second ratio of transmission provides for the main transmission. Since the first ratio of transmission is also positive and more than 1 and the two ratios of transmission are multiplied, the pliers are especially suitable for applying great crimping forces.

Figure 2:
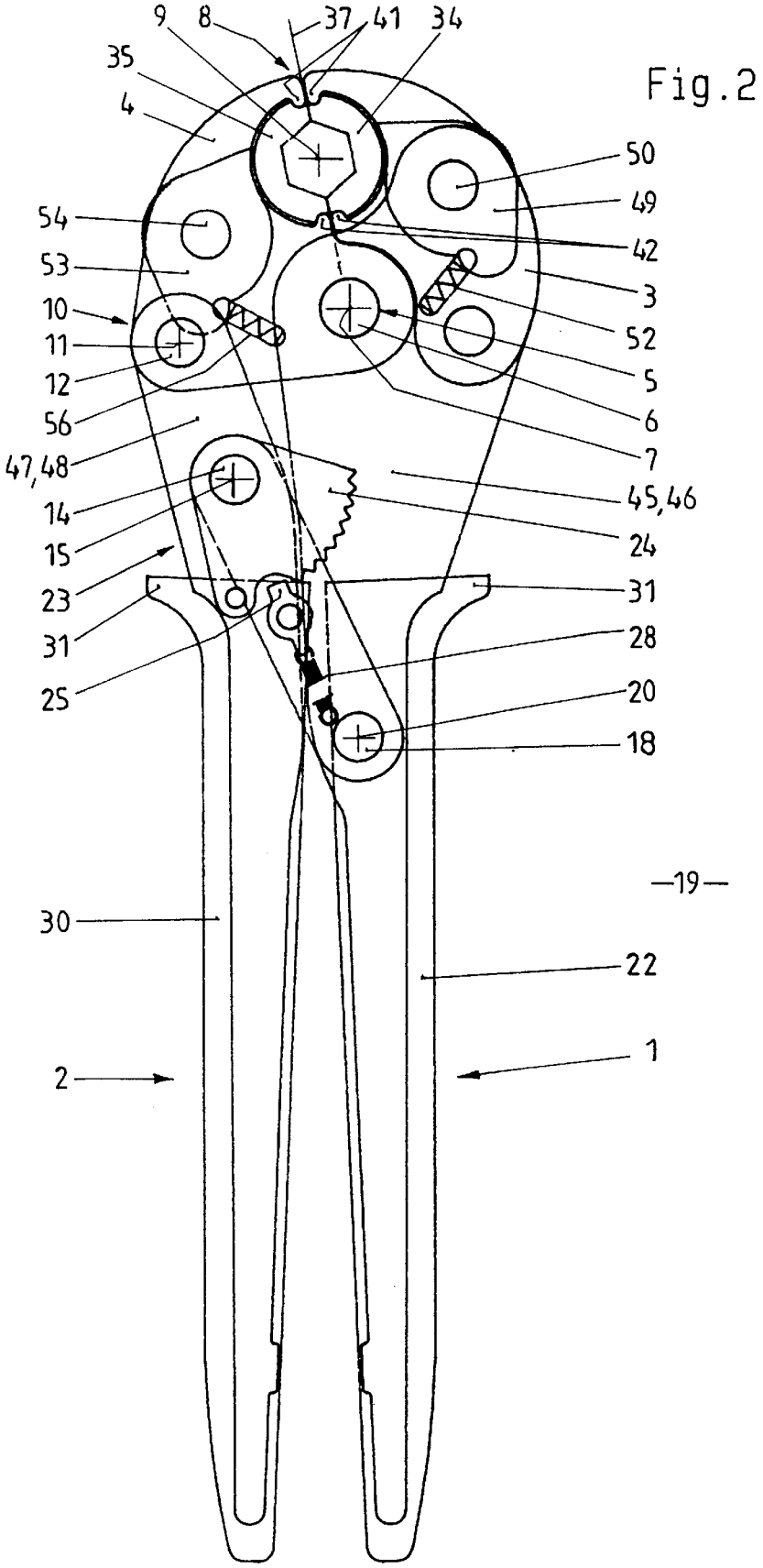
FIG. 2 is a side view of a second embodiment of the pliers in their closed position.

The design and arrangement of the elements, especially of the crimping die 8, the joint 5 and the support joint 10, 13 and 17 as well as the pressure lever 16, is chosen such that the handles 1 and 2 in the opened position of the pliers (FIG. 1) may be grasped by the fingers of one hand of the user to be moved in a direction towards the closing position of the pliers. The pliers include a locking mechanism 23 including a tooth segment 24 and a jack 25. The tooth segment 24 is supported on the pin 14 of the support joint 13 within the plates of the handle 2. A fixing pin 26 extending through the plates of the handle 2 prevents the tooth segment 24 from rotating about the axis 15. It is to be understood that the tooth segment 24 and the plate of the movable handle 2 may also be designed as one piece. The jack 25 is pivotally supported on a stud 27, and it is subjected to a force by a pulling spring 28 towards the illustrated position being aligned to the pressure lever 16. A free portion 29 for inverting the sense of rotation of the jack 25 is located close to the teeth of the tooth segment 24 and in a direction towards the fixing bolt 26. It is to be seen that the locking mechanism 23 locks in at the beginning of the closing movement during a change from the opened position (FIG. 1) into the closed position (FIG. 2). Consequently, even if the user does not hold the pliers any longer, the handles 1 and 2 cannot return to their opened position according to FIG. 1. The essential first part of the closing movement takes place without substantial counter forces. The crimping die 8 surrounds the work piece. The actual crimping process takes place in the last part of the closing movement. The necessary crimping force is built up during the actual crimping process. The crimping force reproducibly attains is its greatest value in the end position as illustrated in FIG. 2. It is to be seen from a comparison of FIGS. 1 and 2 that in the opened position a line connecting the axes 15 and 20 of the support joints 13 and 17 and a line connecting the axes 11 and 15 approximately form a right angle. Consequently, during the first part of the closing movement, the support joint 10 moves with respect to the stationary handle 1, whereas the support joint 13 does not substantially move, and it only moves along a comparatively short path, respectively. This movement is chosen to move the pivot jaws 3 and 4 at the beginning of a closing movement starting from the opened position according to FIG. 1 through a great pivot angle, and to arrange the crimping die 8 such that it surrounds the work piece to be crimped. It is also to be seen from FIG. 1 that the axis 11 of the support joint 10 only moves on one side of an imaginary line connecting the axes 7 and 15. This means that the angle between the line connecting the axes 11 and 7 and the connecting line on the side of the stationary handle 1 is less than 180 degrees. The angle is approximately 90 degrees in the closed position according to FIG. 2. The angle may be in a range of approximately 85 degrees to 95 degrees in the closing position. Thus, the pressing force being transmitted from the portion 21 onto the pivot jaw 4 is not reduced (90 degrees) or approximately unreduced (85 degrees to 95 degrees) to have an effect on the crimping die 8 via the second ratio of transmission. There may be a spring (not illustrated) serving to move the pliers from their closed position back into their opened position when the jack 25 has reached the free portion 29 and when the pressing forces supplied by the hand of the user no longer subject the handles 1 and 2.

The direction of main extension 36 of the pliers and of the stationary portion of the pliers 1, 3, respectively, in the plane of main extension 19 is formed exactly or approximately by a line connecting the axis 7 of the joint 5 and the axis 20 of the support joint 17. The crimping die 8 with its axis 9 is located outside the direction of main extension 36 by an angle of approximately 15 degrees to 25 degrees, preferably of 19 degrees, as turned away from the direction of main extension 36 in a direction towards the movable handle 2.

The crimping die 8 according to FIG. 1 including the two pressing dies 32 and 33 serves to plastically deform tubes, mountings, union rings, swivel rings and the like, meaning all rotationally symmetric elements and work pieces. For this reason, the two semi shells 34 and 35 are each designed to be rotationally symmetric at their inner circumference. FIG. 2 illustrates an embodiment of the pliers and of the semi shells 34 and 35 with which the crimping die 8 produces a hexagon cross section. No matter what kind of an inner cross section the semi shells have, the semi shells arc always designed to be rotationally symmetric at their outer circumference, and they are always inserted into the pivot jaws 3 and 4, respectively, with a clearance 38, an allowance, a play or a looseness. The clearance 38 is at least realized at one of the semi shells. In this embodiment, the clearance 38 is realized at the semi shell 34 with respect to the pivot jaw 3. The clearance 38 allows for a small displacement of the semi shell 34 in the direction of the plane of separation 37 to center the semi shell 34 at the work piece during the crimping movement. The center points of the two semi shells 34 and 35 at least approach one another. Preferably, they move towards one another until they cover one another. The roundness of the crimped work piece is substantially improved compared to the prior art. The pivot jaws 3 and 4 each include a rounding 39 and 40, respectively, or a flattening to simplify the use of the pliers even in case of tight or narrow mounting conditions. For example, the plier, may also be used to crimp a tube onto a nipple in a water tank of a toilet. The pivot jaws 3 and 4 each include protrusions 41 and 42 facing each other. The clearance 38 is also located in the region of the protrusions 41 and 42. The protrusions 41 and 42 prevent the semi shells from falling out off the pivot jaws 3 and 4 in a radial direction. The protrusions 41 and 42 may be designed as approximately plane surfaces being located at an angle of approximately 60 degrees (FIG. 1) with respect to one another or in the shape of an S (FIG. 2).

The crimping die 8 is closed in the closing position or the end position of the second embodiment of the pliers as illustrated in FIG. 2. The jack 25 is pivoted into the free portion 29 of the tooth segment 24. This arrangement is only possible when the closing position or the end position of the pliers has been realized reproducibly. The pliers may be opened. Usually, the opening movement of pliers is supported by the force of a spring (not illustrated). The pliers according to FIGS. 2 and 4 include plates. In the region of the pliers head, the pliers include plates being arranged in a double and symmetric design with respect to the plane of main extension 19. The plates may be produced with great exactness by punching. The pivot jaw 3 is formed by two plates 43 and 44 supporting the semi shell 32, and by which crimping forces are transmitted onto the work piece. The plates 43 and 44 may also extend continuously along the entire pliers to form the stationary handle 1 from one piece. The plastic cover 22 is slid onto the handle 1. The movable pivot jaw 4 is also formed by two plates 45 and 46 being provided in addition to plates 47 and 48 forming the movable handle 2. A pivot lever 49 is located between the plates 43 and 44; preferably it is located in the plane of main extension 19 to be pivotal about a bolt 50 (FIG. 2). The semi shell 32 includes a continuous channel 51 being detachably engaged by the pivot lever 49 under the force of a spring 52 to secure the semi shell 32 in an axial direction of the crimping die 8. Accordingly, a pivot lever 53 is located between the plates 45 and 46; preferably it is located in the plane of main extension 19 to be pivotal about a bolt 14 (FIG. 2). The semi shell 3 includes a continuous channel 55 being detachably engaged by the pivot lever 53 under the force of a spring 56 to secure the semi shell 33 in an axial direction of the crimping die 8. The pivot levers 49 and 53 allow for a quick replacement of the semi shell 32 and 33. They may be manually pivoted into the lose position by pressing the springs 52 and 56, respectively, such that the semi shells 32 and 33 may be replaced in the direction of the axis 9 of the crimping die 8.

Figure 3:
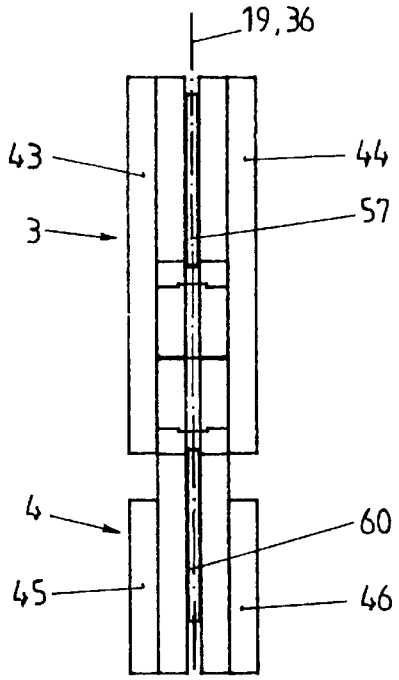
FIG. 3 is a front view of the pliers according to FIG. 1.

FIG. 3 illustrates a side view of the pliers head of the pliers according to FIG. 1. The pliers include three plates. The pivot jaw 3 is formed by the two plates 43 and 44 and by a center plate 57 being arranged to be symmetric with respect to the plane of main extension 19. Similar to the pivot lever 49, the center plate 57 engages a channel of the semi shell 32 to axially secure the semi shell 32. The center plate 57 is pivotally supported at the plates 43 and 44 by a stud 58 (FIG. 1), and a replaceable securing bolt 59 fixes it. After the securing bolt 59 has been removed, the center plate 57 may be pivoted out of the channel of the semi shell 32. The semi shell 32 may then be removed from the pivot jaw 3 and from the plates 43 and 44, respectively, in an axial direction to be replaced. Correspondingly, with respect to the pivot jaw 4 and the two plates 45 and 46, respectively, a center plate 60 is arranged to be symmetric with respect to the plane of main extension 19. Similar to the pivot lever 53, the center plate 60 engages a channel of the semi shell 33 to axially secure the semi shell 33. The center plate 60 is pivotally supported at the plates 45 and 46 by a bolt 12 (FIG. 1), and a securing bolt 61 fixes it. After the securing bolt 61 has been removed, the center plate 60 may be pivoted out of the channel of the semi shell 33. The semi shell 33 may be removed from the pivot jaw 4 and from the plates 45 and 46, respectively, in an axial direction. This embodiment of the pliers is preferred in case it is especially important to replace worn out semi shells 32 and 33. The center plates 57 and 60 fulfill a double function. They do not only serve to axially secure the semi shells 32 and 33, respectively, but they also transmit part of the pressing forces.

Many variations and modifications may be made to the preferred embodiments of the invention without departing substantially from the spirit and principles of the invention. All such modifications and variations are intended to be included herein within the scope of the present invention, as defined by the following claims.

We claim:

1. Pliers for crimping work pieces, comprising:

a first stationary handle;

a second movable handle, said first and second handle being designed and arranged to be movable with respect to one another and to be operable by one hand;

a first pivot jaw being connected to said first stationary handle to form a stationary pliers portion and including a first protrusion;

a second pivot jaw being connected to said second movable handle and including a second protrusion, said first and second pivot jaw each including at least two parallel plates extending symmetrically to a plane of main extension of said pliers;

a common joint pivotally connecting said stationary pliers portion and said second pivot jaw;

a first die being designed as a semi shell and to be insertable into said first pivot jaw; and a second die being designed as a semi shell and to be insertable into said second pivot jaw, said first and second die together forming a crimping die and being designed and arranged to contact one another in a closed position of said pliers in a separation plane, at least one of said semi shells being arranged at said corresponding pivot jaw with a clearance to be movable in the separation plane in the sense of a centering adjustment of said semi shells, said first and second protrusion being designed and arranged to support said corresponding semi shell and to fix said corresponding die in a radial direction.

2. The pliers of claim 1, further comprising a locking mechanism being designed and arranged to attain a defined closed position of said first and second die in the separation plane.

3. The pliers of claim 2, wherein said locking mechanism is arranged between said stationary first handle and said second pivot jaw.

4. The pliers of claim 1, further comprising a toggle lever drive including a plurality of supporting joints and a pressure lever operatively connecting said first and second handle.

5. The pliers of claim 1, wherein each of said pivot jaws includes three plates, a center plate of which being located parallel to and within the plane of main extension of said pliers, the plane of main extension extending perpendicular to the separation plane and parallel to said pivot jaws.

6. The pliers of claim 5, wherein said center plate is designed and arranged to be pivotal with respect to said other plates to allow for a replacement of said dies.

7. The pliers of claim 1, further comprising a securing pin connecting said plates.

8. The pliers of claim 7, wherein said securing pin is designed and arranged to be removable.

9. The pliers of claim 1, further comprising a manually operable pivot lever being connected to said die and being designed and arranged to allow for a replacement of said die.

10. The pliers of claim 5, further comprising a manually operable pivot lever being connected to said die and being designed and arranged to allow for a replacement of said die.

11. The pliers of claim 1, wherein said first and second protrusion extends from said pivot jaw at an angle of more than 90 degrees.

12. The pliers of claim 1, wherein said first and second protrusion extends from said pivot jaw at an angle of approximately 120 degrees.

13. The pliers of claim 1, wherein each of said handles includes a plastic cover including an outwardly extending protrusion.

14. The pliers of claim 1, wherein the work pieces are selected from a group consisting of fittings, tubes and cable lugs.

15. Pliers for crimping work pieces, comprising:

a first stationary handle;

a second movable handle, said first and second handle being designed and arranged to be movable with respect to one another and to be operable by one hand;

a first pivot jaw being connected to said first stationary handle to form a stationary pliers portion and including a first protrusion;

a second pivot jaw being connected to said second movable handle and including a second protrusion, said first and second pivot jaw each including at least two parallel plates extending symmetrically to a plane of main extension of said pliers;

a common joint pivotally connecting said stationary pliers portion and said second pivot jaw;

a first die being designed as a semi shell and to be insertable into said first pivot jaw;

a second die being designed as a semi shell and to be insertable into said second pivot jaw, said first and second die together forming a crimping die and being designed and arranged to contact one another in a closed position of said pliers in a separation plane, at least one of said semi shells being arranged at said corresponding pivot jaw with a clearance to be movable in the separation plane in the sense of a centering adjustment of said semi shells, said first and second protrusion being designed and arranged to support said corresponding semi shell and to fix said corresponding die in a radial direction;

a locking mechanism being designed and arranged to attain a defined closed position of said first and second die in the separation plane; and a toggle lever drive including a plurality of supporting joints and a pressure lever operatively connecting said first and second handle.

16. The pliers of claim 15, wherein said locking mechanism is arranged between said stationary first handle and said second pivot jaw.

17. The pliers of claim 15, wherein each of said pivot jaws includes three plates, a center plate of which being located parallel to and within the plane of main extension of said pliers, the plane of main extension extending perpendicular to the separation plane and parallel to said pivot jaws.

18. The pliers of claim 17, wherein said center plate is designed and arranged to be pivotal with respect to said other plates to allow for a replacement of said dies.

19. The pliers of claim 15, further comprising a securing pin connecting said plates.

* * * * *